US006105723A

United States Patent [19]

D'Alessio

[11] Patent Number: 6,105,723

[45] **Date of Patent: *Aug. 22, 2000**

[54] STEEL PLANK FOR SCAFFOLDING

[75] Inventor: Michael S. D'Alessio, Flushing, N.Y.

[73] Assignee: Harsco Corporation, Camp Hill, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/771,873

[22] Filed: Dec. 23, 1996

[51] Int. Cl.[7] ..... E04G 1/16

[52] U.S. Cl. ..... 182/222; 182/119

[58] Field of Search ..... 182/115, 116, 182/117, 118, 119, 178.1, 179.1, 222, 223; 108/51.1

[56] References Cited

U.S. PATENT DOCUMENTS

| | | | |
|---|---|---|---|
| 534,853 | 2/1895 | Bruner | 182/222 X |
| 962,691 | 6/1910 | Anderson . | |
| 2,180,502 | 11/1939 | Bonsall | 182/222 X |
| 2,412,778 | 12/1946 | Kosek | 182/222 X |
| 2,649,304 | 8/1953 | Ulanovsky | 182/222 X |
| 3,093,216 | 6/1963 | Dunham . | |
| 3,561,374 | 2/1971 | Honderich . | |
| 3,884,328 | 5/1975 | Williams . | |
| 4,331,218 | 5/1982 | Layher | 182/119 X |
| 4,340,130 | 7/1982 | Payne et al. | 182/119 X |
| 4,349,297 | 9/1982 | Misener | 182/222 X |
| 4,372,424 | 2/1983 | Langer | 182/119 |
| 4,496,029 | 1/1985 | Kuroda . | |
| 4,631,874 | 12/1986 | Griffin, Jr. . | |
| 4,742,890 | 5/1988 | de Blauw . | |
| 4,811,530 | 3/1989 | Eyerly | 182/222 X |
| 4,852,691 | 8/1989 | Bruno | 182/222 |
| 4,959,941 | 10/1990 | Schoeneberg . | |
| 4,984,654 | 1/1991 | Anderson | 182/222 X |
| 5,143,173 | 9/1992 | Lubinski | 182/119 |
| 5,145,032 | 9/1992 | Puccinelli et al. | 182/119 X |
| 5,443,137 | 8/1995 | Welser . | |
| 5,555,955 | 9/1996 | D'Alessio . | |
| 5,613,339 | 3/1997 | Pollock . | |

FOREIGN PATENT DOCUMENTS

| | | |
|---|---|---|
| 347476 | 12/1989 | European Pat. Off. . |
| 2690188 | 10/1993 | France . |
| 775189 | 5/1957 | United Kingdom . |
| 1245942 | 9/1971 | United Kingdom . |
| 1556553 | 11/1979 | United Kingdom . |
| 1590522 | 6/1981 | United Kingdom . |

OTHER PUBLICATIONS

Thyssen Hünnebeck scaffold brochure (22 pages) (Jun. 1993).

*Primary Examiner*—Daniel P. Stodola
*Assistant Examiner*—Richard M. Smith
*Attorney, Agent, or Firm*—Kirkpatrick & Lockhart LLP

[57] ABSTRACT

A steel plank for scaffolding which comprises a thin sheet metal bendment with a top surface and a bottom surface. The steel plank also comprises an elongated bottom plate attached to the thin sheet metal bendment. The steel plank further comprises a non-slip material attached to the bottom side of the bottom plate.

19 Claims, 5 Drawing Sheets

STEEL PLANK FOR SCAFFOLDING

BACKGROUND OF THE INVENTION

1. Field of the Invention

The present invention relates to steel planks for scaffolding and, more particularly, is directed to a steel plank for scaffolding that has a bottom plate that is coated with a non-slip surface.

2. Description of the Invention Background

Scaffolding is used in a variety of industrial and construction settings as an elevated platform for workers and equipment. Scaffolding typically consists of planks that rest horizontally on a vertical metal frame or are lapped on top of other planks that rest on the metal frame.

The most common type of material for plank construction is wood. Wood has a high coefficient of friction and therefore the planks do not easily slip off of the metal frame or off of other planks. Wooden planks may also be nailed together to increase the stability of a scaffolding structure and to reduce slippage of the planks.

The use of wood as a material for plank construction has many disadvantages. Wooden planks are typically expensive because a high grade of wood must be used in their construction. Scaffolding is often used in harsh environments such as in oil refineries, petrochemical plants, and paper mills where chemicals such as acids come into contact with the scaffolding structure. Exposure to chemicals causes wooden planks to deteriorate and weaken, which directly affects the load-bearing capacity of the planks. Wooden planks must be inspected and tested before each use. The testing procedure is such that it may actually weaken the wooden planks. Thus, under normal usage, wooden planks typically last about 3 to 4 years until they need replaced.

Wood also has the disadvantage that it becomes slippery when wet. Thus, if wooden planks are used in applications where water is present or if they are used in adverse weather conditions, the planks may become unsafe for the workers using the scaffolding. Also, wooden planks have the disadvantage of being heavy due to their solid mass. Because of this disadvantage, transportation of wooden planks and scaffolding construction using wooden planks is burdensome.

The prior art has attempted to solve the many problems inherent in wooden planks by constructing the planks out of metal. However, metal does not have the high coefficient of friction that wood has and thus prior art metal planks do not have the non-slip safety advantage of wooden planks. The Applicant of the present invention has proposed a solution to the slippage of metal planks in U.S. Pat. No. 5,555,955, wherein a combination scaffold plank was disclosed that is comprised of a channel-shaped metal plank with slip-resistant blocks fastened to its underside. The blocks prevent the planks from slipping off of the metal frame or off of each other. The invention further discloses a board fastened to the bottom of the blocks which creates a uniform surface that runs the length of the plank. The prior invention has the advantage of the strength of a metal plank and the non-slip surface of wood. However, the prior invention has the disadvantage in that the planks are still constructed partially of wood, which is subject to deterioration, especially in harsh environments.

As such, there is a need for a steel plank for scaffolding that has a bottom plate that reinforces the steel plank and has a non-slip bottom surface which prevents slipping and enhances the safety of the steel plank when used by workers.

There is also a need for a low-cost steel plank for scaffolding that will not deteriorate over time in the adverse environments in which such planks are often used.

The subject invention is directed toward an improved steel plank which overcomes, among others, the above discussed problems and provides a steel plank which has the non-slip property of wooden planks yet has the safety and durability of a steel plank.

SUMMARY OF THE INVENTION

In accordance with the particular preferred form of the present invention, there is provided a steel plank for scaffolding which has a bottom plate that reinforces the steel plank and provides a surface that allows for stability of the steel plank when it is placed on a scaffolding frame or another plank. There is also provided a steel plank with a non-slip surface on the underside of the bottom plate of the steel plank.

It is an object of the present invention to provide a steel plank for scaffolding that has the low cost advantages of steel planks and the safety advantages of wooden planks. It is a further object of the present invention to provide a steel plank for scaffolding that has a bottom reinforcement plate. It is also an object of the present invention to provide a steel plank for scaffolding that has a non-slip surface on the underside of the bottom reinforcement plate of the steel plank.

These and other details, objects, and advantages of the invention will become apparent as the following description of the present preferred embodiment thereof proceeds.

BRIEF DESCRIPTION OF THE DRAWINGS

In the accompanying drawings, there is shown a present preferred embodiment of the invention wherein like reference numerals are employed to designate like parts and wherein.

DETAILED DESCRIPTION OF THE PREFERRED EMBODIMENTS

Figure 1:
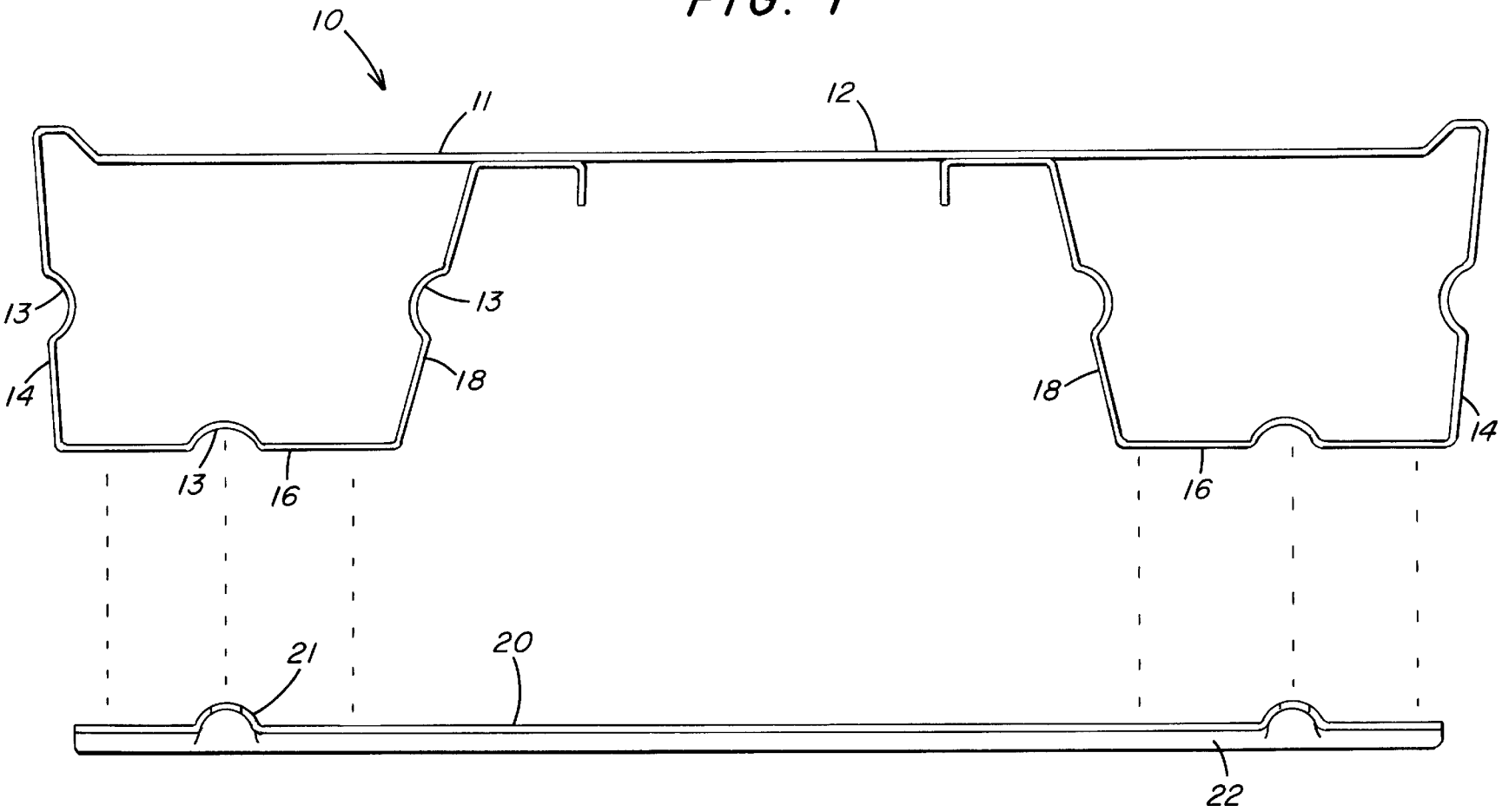
FIG. 1 is a horizontal profile view of a preferred embodiment of the present invention.

Referring now to the drawings for the purposes of illustrating the present preferred embodiments of the invention only and not for purposes of limiting the same, the Figures show a steel plank for scaffolding generally designated as 10. FIG. 1 shows a horizontal profile view of the steel plank 10. The steel plank 10 is comprised of two elements in a first preferred embodiment. The longitudinal ends of a thin sheet metal bendment 12 are bent under the thin sheet metal bendment 12 to form a top surface 11, side flanges 14, bottom surfaces 16, and return flanges 18. Preferably, ridges 13 are formed in the surfaces 14, 16 and 18 for strength and rigidity. It can be understood by those skilled in the art that the thin sheet metal bendment 12 does not have to be formed such that trapezoidal voids are created. Any shape that provides the thin sheet metal bendment 12 with the required strength needed for use in scaffolding applications is appropriate. The technique of forming structures that provide strength to a thin sheet of metal is well known in the art and is outlined in the American Iron and Steel Institute Cold Formed Steel Design Manual.

The steel plank 10 also has a bottom plate 20 which can be fastened to the bottom surfaces 16 of the thin sheet metal bendment 12. The bottom plate 20 may be fastened to the thin sheet metal bendment 12 by fasteners, such as rivets or bolts, or can be welded or soldered. The bottom plate 20 provides added strength to the steel plank 10 and also provides a stable surface for the steel plank 10 to rest upon other steel planks or the metal frame of a scaffolding structure. The bottom plate 20 may extend the entire longitudinal length of the thin sheet metal bendment 10 or, in a preferred embodiment, may be limited to a certain length, such as 18 inches, in order to save materials and manufacturing costs. Furthermore, raised portions 21 may be provided in bottom plate 20 to provide strength and rigidity. Preferably, raised portions 21 nest with ridges 13 in bottom surface 16. Also, the raised portions 21 preferably provide a recess in which the head of a fastener may rest such that the bottom plate 20 provides a flush surface on which the plank may rest.

In a preferred embodiment, a non-slip material 22 is attached to the bottom surface of the bottom plate 20. The non-slip material 22 can be rubber, a polymer, an epoxy, or any other material that has a high coefficient of friction. The non-slip material 22 can be coated onto the bottom surface of the bottom plate 20 or can be attached using fasteners or adhesives. The non-slip material 22 prevents the steel plank 10 from slipping off of the metal frame of a scaffolding structure or from slipping horizontally when stepped on. The non-slip material 22 also prevents the steel plank 10 from slipping off of other steel planks when they are lapped together, even if the steel plank 10 is only half resting on the steel plank below it.

It can be understood by those skilled in the art that different metals, such as aluminum and steel, may be used to construct the thin sheet metal bendment 12 and the bottom plate 20. If the thin sheet metal bendment 12 and the bottom plate 20 are constructed of steel, the thin sheet metal bendment 12 and the bottom plate 20 may be treated to prevent corrosion and deterioration of the steel. Such treatments include hot dip galvanizing, electro-galvanizing plating, or coating the steel.

Figure 2:
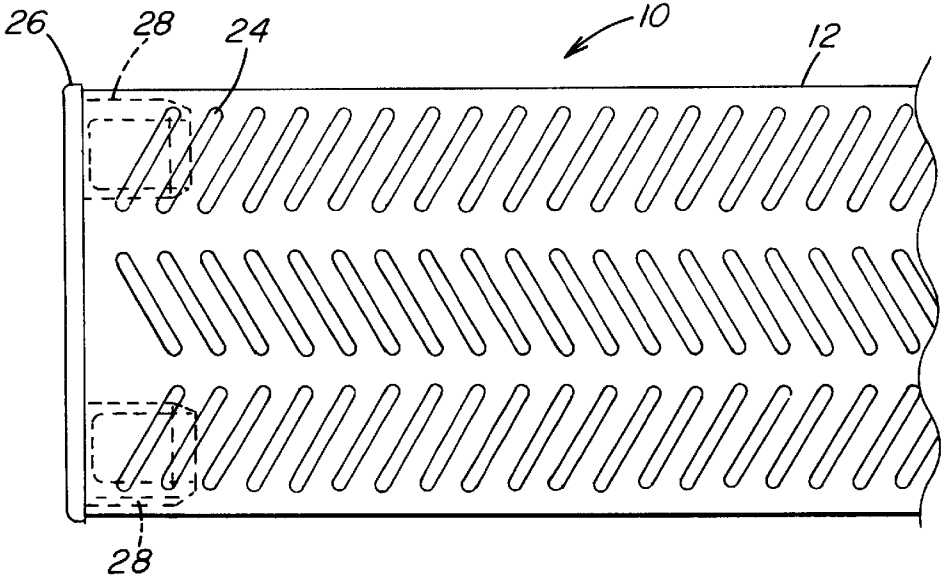
FIG. 2 is a top view of a preferred embodiment of the present invention.

FIG. 2 shows a top view of another preferred embodiment of a portion of the steel plank 10 of the present invention. Raised anti-skid elements 24 are arranged in a herringbone pattern on the thin sheet metal bendment 12. An end cap 26 has plastic castings 28 that are shown fitted into an end of the steel plank 10. The end cap 26 prevents workers from catching their feet in the trapezoidal voids of the thin sheet metal bendment 12 and the space between the thin sheet metal bendment 12 and the bottom plate 20 when the steel plank 10 is lapped upon other steel planks. Thus, the end cap 26 provides added safety to the steel plank 10.

Figure 3:
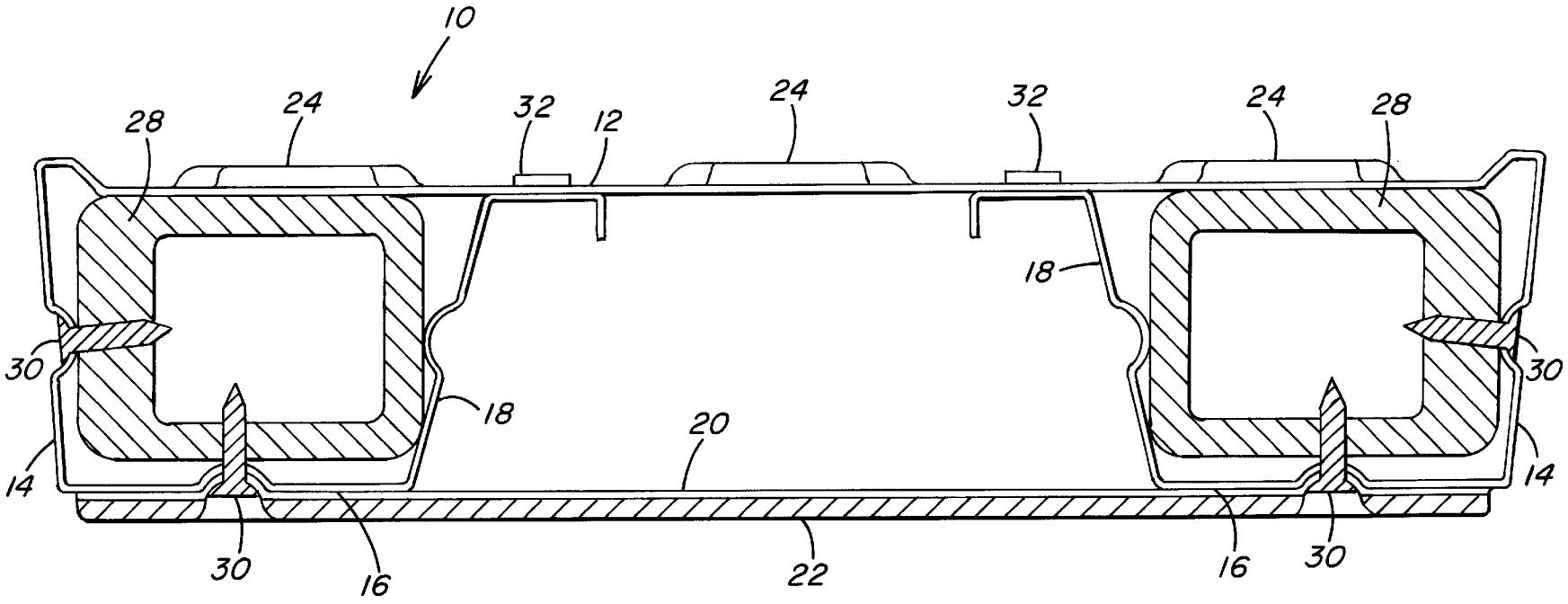
FIG. 3 is a horizontal profile view of a preferred embodiment of the present invention.

FIG. 3 shows a horizontal cross section view of the preferred embodiment of the steel plank 10 of FIG. 2. The trapezoidal voids of the thin sheet metal bendment 12 are filled with the end cap castings 28. The end cap castings 28 further strengthen the steel plank 10 and provide a filler to which the bottom plate 20 can be attached. The end cap castings 28 can be constructed out of any material, such as a plastic polymer, that provides strength to the thin sheet metal bendment and is capable of accepting fasteners.

The bottom plate 20 is attached to the thin sheet metal bendment 12 by fasteners 30. The fasteners 30 can be nails, screws, rivets, bolts, or any type of fastener that can securely mate the bottom plate 20 to the thin sheet metal bendment 12.

FIG. 3 shows the return flanges 18 of the thin sheet metal bendment 12 attached to the thin sheet metal bendment 12 by crimped joints 32. Portions of the top surface of the thin sheet metal bendment 12 are embossed with the raised anti-skid elements 24. The raised anti-skid elements 24 prevent workers on the steel plank 10 from slipping, especially when the steel plank 10 is used in an environment in which the steel plank 10 becomes wet with water or with chemicals. The raised anti-skid elements 24 can be extruded onto the thin sheet metal bendment 12. The raised anti-skid elements 24 may also be a non-skid material, such as a polymer material or an epoxy material, that is affixed to or adhered to the steel plank 10 and does not deteriorate when subjected to use in harsh environments.

Figure 4:
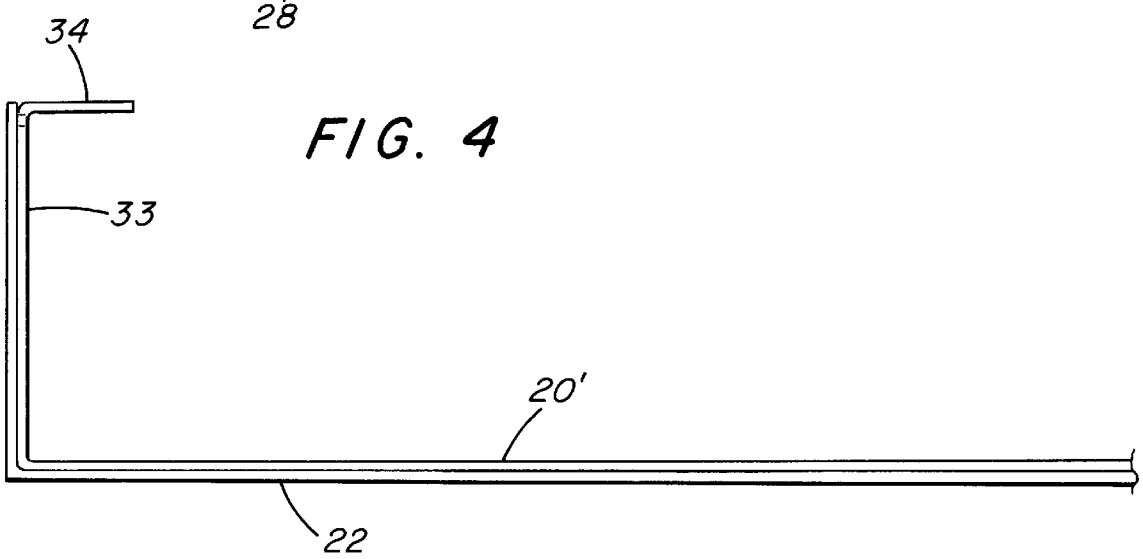
FIG. 4 is a longitudinal profile view of a preferred embodiment of the bottom plate of the present invention.

FIG. 4 shows a longitudinal profile view of another preferred embodiment of the bottom plate 20' of the present invention. The bottom plate 20' is bent to form a side flange 33 and two top flanges 34. The top flanges 34 may be attached to the bottom of the top surface 11 of the thin sheet metal bendment 12 by conventional fasteners or known welding techniques. The bottom plate 20' may also be attached to the bottom surfaces 16 of the thin sheet metal bendment 12 by a conventional fastener or welding technique. The side flange 33 covers the trapezoidal voids of the thin sheet metal bendment 12 and thus may be used in lieu of end cap 26.

The non-slip material 22 is attached to the bottom surface of the bottom plate 20', and can extend to cover the side flange 33. The non-slip material 22 can be rubber, a polymer, an epoxy, or any other material that has a high coefficient of friction. The non-slip material 22 can be coated onto the bottom surface of the bottom plate 20' or can be attached using fasteners or adhesives.

Figure 5:
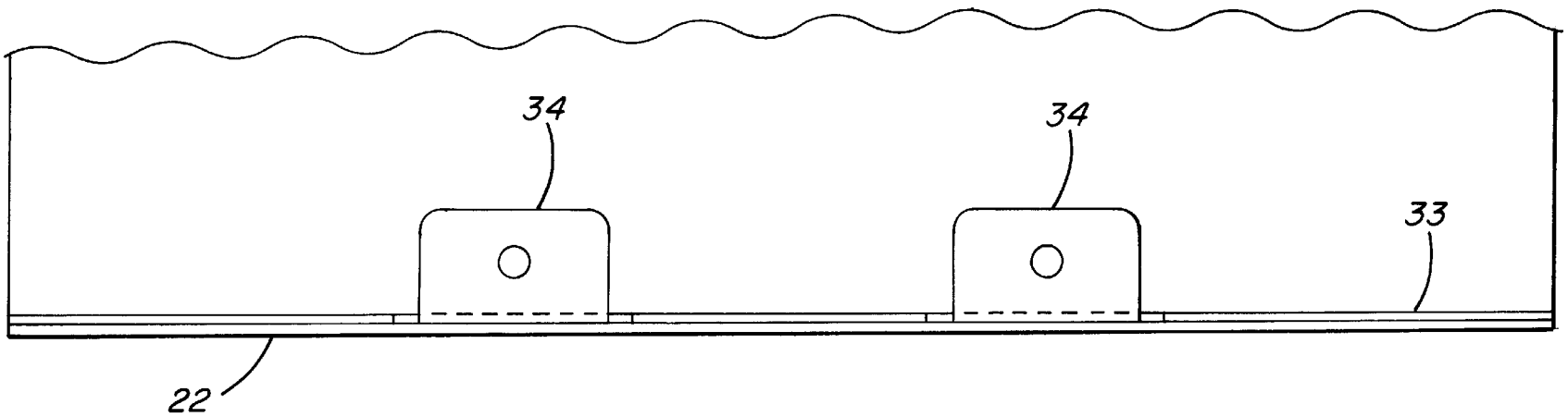
FIG. 5 is a top view of the preferred embodiment of the bottom plate of FIG. 4.

FIG. 5 shows a top view of the bottom plate 20' of FIG. 4, showing only the side flange 33 and the top flanges 34. The top flanges 34 are machined to accept fasteners, which may be used to attach the top flanges 34 to the thin sheet metal bendment 12.

Figure 6:
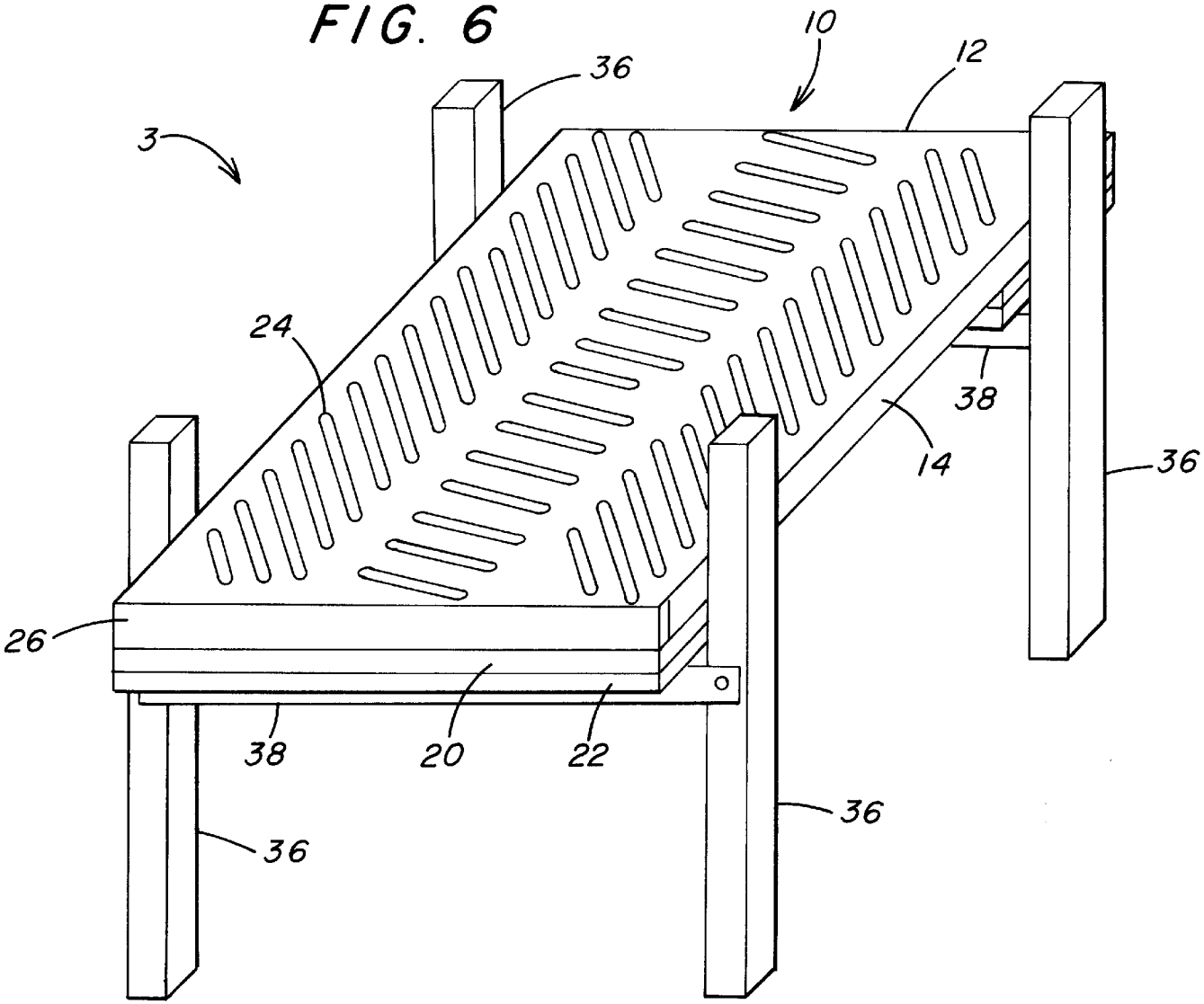
FIG. 6 is a view of a steel plank in combination with a metal scaffolding structure.

FIG. 6 shows a scaffolding structure, generally depicted as 3, which incorporates the steel plank 10 of the present invention. The frame of the scaffolding structure 3 consists of corner posts 36 and horizontal cross members 38. For illustrative purposes, the scaffolding structure 3 as shown in FIG. 6 does not have certain structural elements, such as diagonal bracing members or male receiving members on the corner posts 36 for stacking other scaffolding structures on top of the scaffolding structure 3. The steel plank 10 rests upon the horizontal cross members 38 and the non-slip material 22 on the underside of the bottom plates 20 or 20' prevent the steel plank 10 from sliding or slipping off of the metal frame of the scaffolding structure 3.

As described above, the steel plank for scaffolding 10 of the present invention is particularly well adapted for use in connection with scaffolding structures. The skilled artisan will readily appreciate, however, that the novel features of the present invention may be incorporated into various other scaffold planks, for example, planks that are constructed from a combination of steel and wood. As such, the present invention provides solutions to the aforementioned problems encountered with other known scaffold planks. It will be understood, however, that various changes in the details, materials and arrangements of parts which have been herein described and illustrated in order to explain the nature of the invention may be made by those skilled in the art within the principle and scope of the invention as expressed in the appended claims.

What is claimed is:

1. A steel plank for scaffolding comprising:

a thin sheet metal bendment having a top surface, a first side surface connected to a first side of said top surface and a second side surface connected to a second opposing side of said top surface, first and second bottom surfaces connected to said first and second side surfaces, respectively, and spaced from and parallel to said top surface, said first bottom surface being coplanar with and laterally spaced from said second bottom surface, and return portions extending between each of said first and second bottom surfaces and contacting the underside of said top surface; and a bottom plate having a bottom side, said bottom plate directly attached to said first and second bottom surfaces of said thin sheet metal bendment, and non-slip material attached to said bottom side of said bottom plate.

2. The steel plank of claim 1 wherein said non-slip material is plastic.

3. The steel plank of claim 1 wherein said non-slip material is rubber.

4. The steel plank of claim 1 wherein said non-slip material is epoxy.

5. The steel plank of claim 1 wherein said non-slip material is a polymer.

6. The steel plank of claim 1 wherein said bottom plate has a side flange and at least one top flange, said top flange attached to said top surface of said thin sheet metal bendment, said bottom plate attached to said first and second bottom surfaces of said thin sheet metal bendment, and said side flange covering an end of said thin sheet metal bendment.

7. The steel plank of claim 6 wherein said non-slip material is attached to said bottom side of said bottom plate and said side flange.

8. The steel plank of claim 1 further comprising raised anti-skid elements attached to said top surface of said thin sheet metal bendment.

9. The steel plank of claim 8 wherein said raised anti-skid elements are extruded onto said top surface of said thin sheet metal bendment.

10. The steel plank of claim 8 wherein said raised anti-skid elements are constructed of a polymer.

11. The steel plank of claim 8 wherein said raised anti-skid elements are constructed of rubber.

12. The steel plank of claim 8 wherein said raised anti-skid elements are constructed of epoxy.

13. The steel plank of claim 8 wherein said raised anti-skid elements are constructed of plastic.

14. The steel plank of claim 1 further comprising at least one end cap having at least one pasting, said casting inserted into an end of said thin sheet metal bendment.

15. The steel plank of claim 14 wherein said end cap is constructed of plastic.

16. The steel plank of claim 14 wherein said end cap is constructed of wood.

17. The steel plank of claim 14 wherein said end cap is constructed of a polymer.

18. The steel plank of claim 14 wherein said end cap is constructed of rubber.

19. A scaffolding structure comprising:

a scaffolding frame having a plurality of corner posts and a plurality of horizontal cross members; and a steel plank for scaffolding positioned upon said horizontal cross members of said scaffolding frame, said steel plank for scaffolding comprising:

a thin sheet metal bendment having a top surface, a first side surface connected to a first side of said top surface and a second side surface connected to a second opposing side of said top surface, first and second bottom surfaces connected to said first and second side surfaces, respectively, and spaced from and parallel to said top surface, said first bottom surface being coplanar with and laterally spaced from said second bottom surface and return portions extending between each of said first and second bottom surfaces and contacting the underside of said top surface; and a bottom plate having a bottom side, said bottom plate directly attached to said first and second bottom surfaces of said thin sheet metal bendment, and non-slip material attached to said bottom side of said bottom plate.

* * * * *